United States Patent [19]

Scherbing

[11] 4,328,691

[45] May 11, 1982

[54] ALARM SWITCH MECHANISM FOR AXIAL PIN TUMBLER LOCKS

[75] Inventor: Frank J. Scherbing, Cook County, Ill.

[73] Assignee: Fort Lock Corporation, River Grove, Ill.

[21] Appl. No.: 175,761

[22] Filed: Aug. 6, 1980

[51] Int. Cl.[3] ..... E05B 27/08

[52] U.S. Cl. ..... 70/363; 70/441; 70/DIG. 49

[58] Field of Search ..... 70/363, 419, 439, 441, 70/DIG. 49; 200/42 R, 44, 61.66

[56] References Cited

U.S. PATENT DOCUMENTS

| | | | |
|---|---|---|---|
| 3,878,700 | 4/1975 | Lopez | 70/363 |
| 3,903,720 | 9/1975 | Scherbing | 70/363 |
| 3,986,376 | 10/1976 | Lack | 70/364 A |
| 4,078,405 | 3/1978 | Steinbach | 70/363 |
| 4,147,905 | 4/1979 | Scherbing | 200/44 |

*Primary Examiner*—Robert L. Wolfe

*Attorney, Agent, or Firm*—Leydig, Voit, Osann, Mayer & Holt, Ltd.

[57] ABSTRACT

An axial pin tumbler type lock with alarm triggering capability upon an attempt at picking by stemmed locking pins which will close a circuit through a contact element wherein the contact element is seated against the rear of the stationary sleeve which is of insulating material, the contact element having openings therein which allow the pin stems to pass through and beyond the contact element, and an insulating ring which is fixed to and rotatable with the spindle, the insulating ring being also made of insulating material and having a plurality of bores that can receive the pin stems thereby preventing the application of the requisite torque to defeat the lock by picking.

5 Claims, 10 Drawing Figures

ALARM SWITCH MECHANISM FOR AXIAL PIN TUMBLER LOCKS

FIELD OF THE INVENTION

The present invention relates generally to axial pin tumbler locks with alarm triggering capability and more particularly to an improved pick resisting axial pin tumbler lock with alarm triggering capabilities.

BACKGROUND AND OBJECTS OF THE INVENTION

Mechanical key actuated locks, even the highest security types such as axial pin tumbler locks, are oftentimes defeated by picking. In the ancient art of locks, it is an accepted fact that there is a continual counteraction between designing more pick resistent devices and the devising of ways of opening such locks without the proper key. Thus, lock manufacturers have come to accept as a fundamental fact that no lock can absolutely prevent intrusion but depending upon the economics and degree of security required, lock designers concentrate upon two basic lock functions which are to make the potential intruder expend time and make noise.

There are innumerable mechanical refinements which have been proposed and undoubtedly will continue to come about that are directed to increasing the amount of skill and therefore the time required to pick or defeat the lock. For example, in one of my prior axial pin tumbler lock patents, U.S. Pat. No. 3,903,720, a cam plate arrangement is disclosed which has an array of openings corresponding with locking pin stems which will hinder the application of the required torque making the lock less susceptable to easy picking especially with certain available tools that have been devised to simulate a key. This with other features of the lock increase the time factor by thwarting simultaneous multiple pin manipulation instead of one pin at a time manipulation.

To provide the function of noise, approaches such as disclosed in U.S. Pat. Nos. 3,878,700; 3,986,376 and 4,078,405, among others, have come about where a pin stem functions as an electrical contact to complete a circuit and actuate an alarm if there is an unauthorized tampering with the lock.

With any of such arrangements, the contact element itself provides not only a physical feel of a limit of pin movement, but it also gives the tamperer an audible reference from which to locate the shear plane. In order to circumvent this infirmity such prior patentees contemplated electrical circuitry which would lock in the alarm once any contact is made and the alarm would continue to sound until it is shut off by authorized personnel having a proper key who can gain access to a reset switch or the like.

Since the use of this type of lock with alarm triggering capability is desirable for vending machines which oftentimes are in locations where continuous and long term sounding of an alarm would be an excessive disturbance to others such as hotel or motel guests, latching in circuits even with timed shutoffs may not be acceptable.

Accordingly, it is a primary object of the invention to provide an axial pin tumbler lock with alarm triggering capabilities which also resists simple picking efforts thereby increasing the manipulation time required in any attempted picking. In this connection, it is a related object to provide an improved axial pin tumbler lock with alarm triggering capability of the aforementioned type which will more closely associate the alarm sounding with tampering actions requiring a greater time span for manipulations that is more apt to discourage or drive away a prospective tamperer.

Another object is to provide such an axial pin tumbler lock with alarm triggering capability that can be conveniently provided in the most conventional and widely used size for axial pin tumbler locks.

A BRIEF DESCRIPTION OF THE DRAWINGS

These and other objects of the invention will become apparent from a description thereof which is to be read in conjunction with the following drawings depicting illustrative axial pin tumbler locks with alarm triggering capabilities according to the invention.

SUMMARY OF THE INVENTION

Briefly, in accordance with the invention there is provided an axial pin tumbler lock with alarm switch capabilities, the components of which are the housing, a rotatable spindle with driver pin sleeve attached thereto, a stationary stemmed combination pin sleeve formed of insulating material with the rear end of the sleeve having a recess receiving a contact element that has openings corresponding to the pin stem openings, and an insulating rear sleeve fixed to the spindle and having an array of openings corresponding to the pin stem openings so that the application of a torque to the spindle is inhibited and the stemmed pin travel distances are lengthened through the contact element.

While the invention will be described in connection with certain preferred embodiments, it will be understood that it is not intended to limit the invention to those embodiments. On the contrary, it is intended to cover all alternatives, modifications and equivalents as may be included within the spirit and scope of the invention.

DETAILED DESCRIPTION

Figure 1:
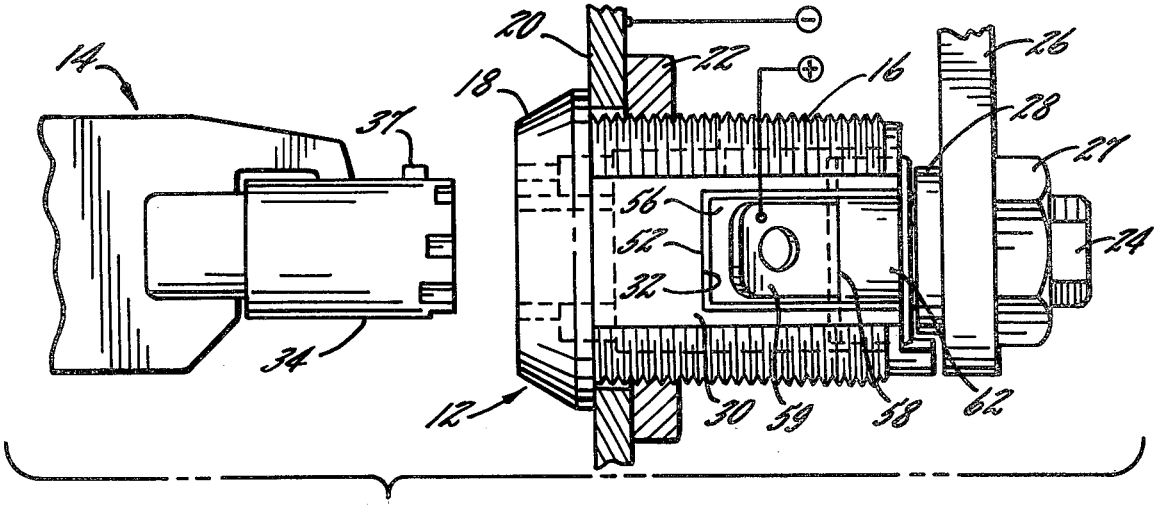
FIG. 1 is a side elevational view of an axial pin tumbler type lock incorporating a switch mechanism combination and the cooperating tubular key, in accordance with the present invention.

Turning now to the drawings, as shown in FIG. 1, an essentially conventional appearing structure for an axial pin tumbler type lock, generally indicated at 12, to be operated by a typical tubular key indicated at 14 has been modified to incorporate an alarm triggering switch mechanism associated with the tumbler pins which is the subject of the present invention. Locks and keys of this general type are illustrated, for example, in U.S. Pat. Nos. 3,041,086 and 3,059,748, and more specifically, a lock of this type even with alarm triggering capabilities is illustrated in U.S. Pat. No. 4,078,405.

As here illustrated in FIG. 1, the lock 12 includes an elongated, threaded tubular body 16 with an enlarged frusto conical head 18 enabling the lock body to be captively held to a metal cabinet 20 or the like by a mounting nut 22, again in a conventional manner. As illustrated in FIG. 1, the rearward end of the lock spindle 24 which is rotatable by a proper key 14 carries a cam element 26 held in place by a nut 27 and spacer ring 28.

Figure 2:
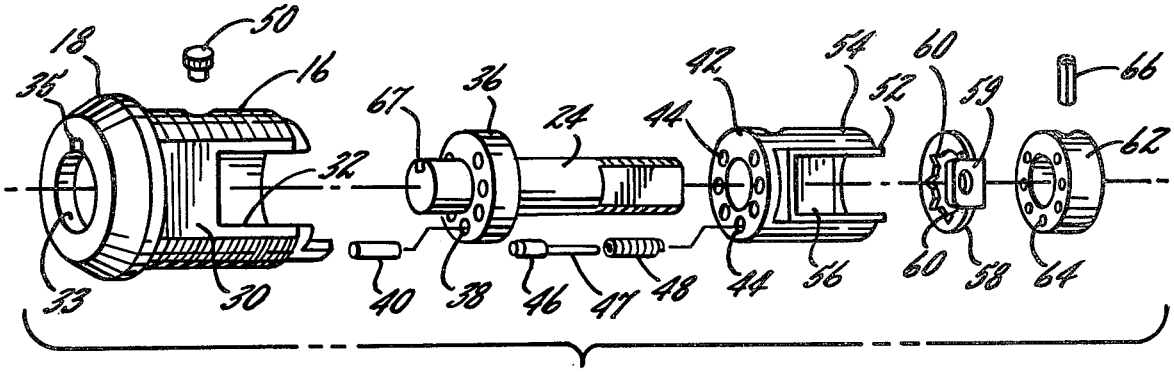
FIG. 2 is an exploded perspective view of the lock mechanism of FIG. 1, on a reduced scale.
Figure 6:
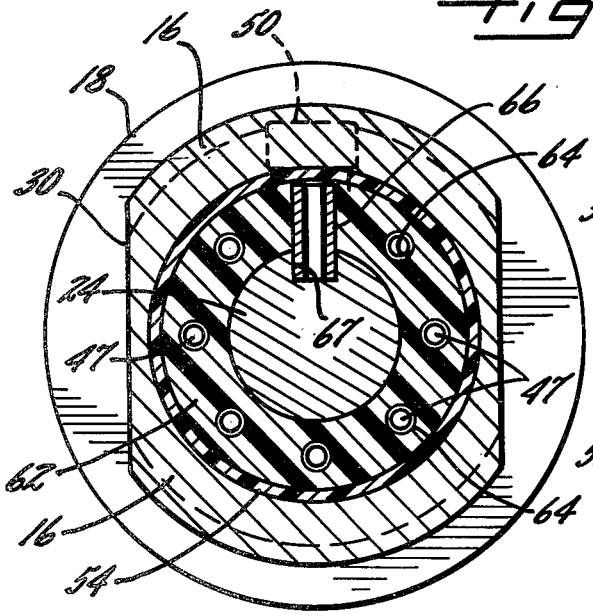
FIG. 6 is a transverse sectional view taken substantially along the line 6—6 in FIG. 3.

Referring to FIG. 2 which is an exploded view of the lock 12, excluding the cam 26 and associate elements 27 and 28, it may be seen that the lock body 16 has a longitudinally extending cylindrical bore and the flat 30 of the wall is provided with a rectangular cutout 32. The frusto conical head 18 includes a reduced diameter opening 33 corresponding with the outer diameter of the tubular key 34 and a cooperating slot 35 is provided for the key lug 37. The operational element of the lock mechanism is the spindle 24 which carries affixed thereto a driver pin sleeve 36 including a plurality of spaced longitudinally extending bores 38. This particular axial pin tumbler as shown is a seven-pin tumbler type so that there are the same number of driver pins 40 disposed in each of the bores 38, although only one such driver pin 40 is here shown.

In keeping with the present invention, the stationary tumbler sleeve 42 has a central longitudinally extending bore for receiving the spindle 24 and contains a plurality of spaced tumbler bores 44, each of which receives a tumbler locking pin 46 having a stem 47 and a spring element 48. With the driving and locking tumbler pins in place and the spindle seated on the stationary sleeve 42, the locking mechanism is assembled to the lock body 16 and fixed by a pin 50 which wedge fits into the stationary sleeve 42.

In accordance with the present invention, the stationary sleeve 42 has a generally rectangular boss 52 which is received in the rectangular cutout 32 of the housing 16. The boss is partially cut away so as to open to a peripheral skirt 54 and there is a recessed platform 56 which is a flat on the surface of the sleeve 42. In keeping with the invention, one switch member is an annular electrical contact element 58 having a bent over prong 59 that inserts into the sleeve 42. The contact element 58 suitably made of brass or other electrically conductive material includes a plurality of generally V-shaped notches 60 corresponding to the locking tumbler bores 44 of the stationary sleeve. The arrangement is such that the contact element 58 when in position is stationary with the stationary sleeve 42 and the stems 47 of tumbler pins 46 forming the other contact member can extend through the stationary sleeve bores 44 and pass through the notches 60.

In addition, according to the invention there is provided an annular insulating ring 62 which also has a plurality of longitudinally extending bores 64 corresponding with the notches and the stationary sleeve bores 44. The insulating ring 62 is received by the rearward end of the spindle and a pin 66 passing through the ring seats in the spindle slot 67 so that the ring 62 is rotatable with the spindle.

Figure 7:
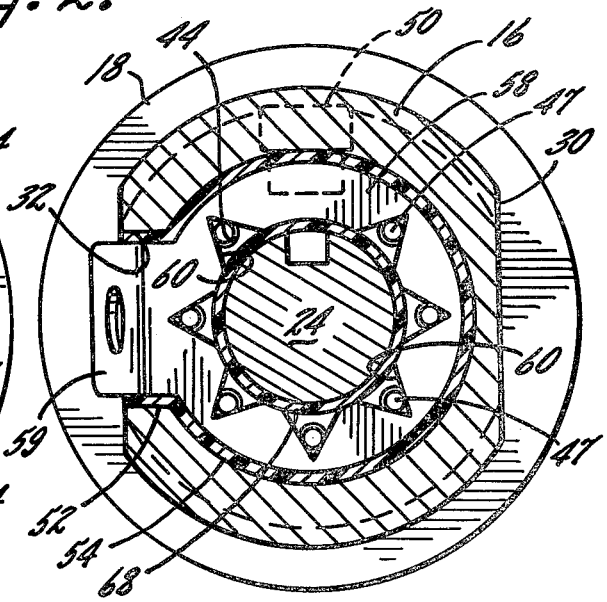
FIG. 7 is a transverse sectional view taken substantially along the line 7—7 in FIG. 3.

Both the stationary sleeve 42 and the ring 62 are constructed of non-conductive material, preferably glass filled nylon and an internal annular lip 68 (FIG. 7) is provided on the sleeve 42 so that the contact element 58 is electrically isolated from the spindle and housing. As illustrated diagramatically in FIG. 1, one circuit lead is connectable to the prong 59 via a slip on connector or the like (not shown) and the other circuit lead contacts to the metal housing 20 carrying the lock or to the lock housing itself. The electrical circuit, it will be appreciated can be any form of conventional buzzer or alarm system (not shown).

Figure 3:
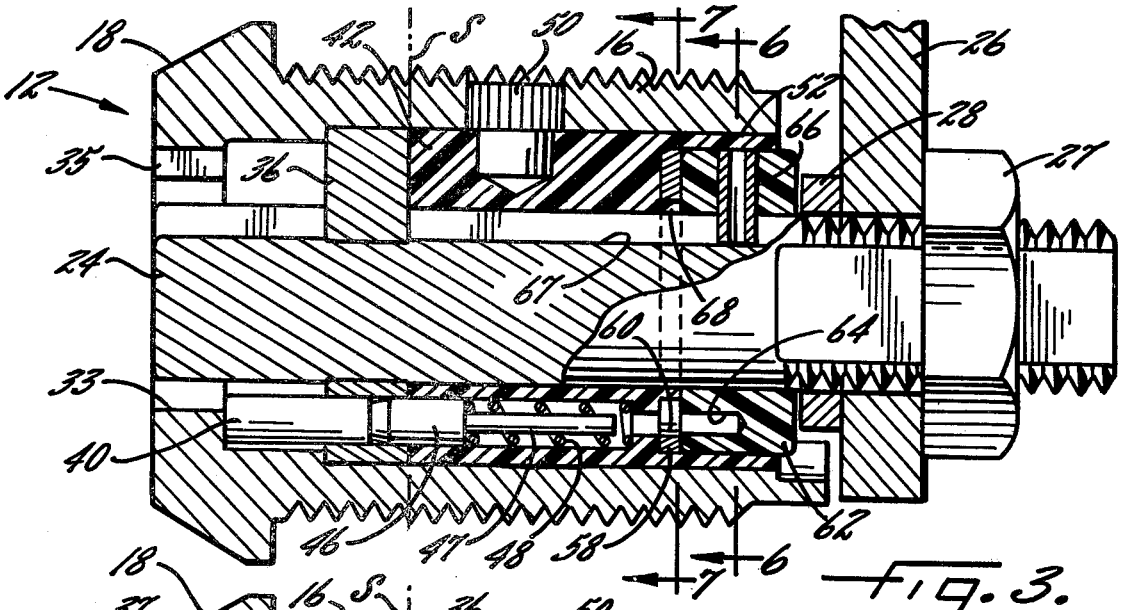
FIG. 3 is an enlarged longitudinal sectional view of the axial pin tumbler lock in FIG. 1.

In order to understand the system more completely, referring to FIG. 3, the lock 12 is there shown in its normal locked position with the locking tumblers 46 being urged forwardly out of the shear plane S so that the spindle 24 and sleeve 36 are fixedly held against rotation. The pin stems 47 are out of any possible contact with the contact element 58 which is fully electrically insulated by sleeve element 42 and the ring element 62.

Figure 4:
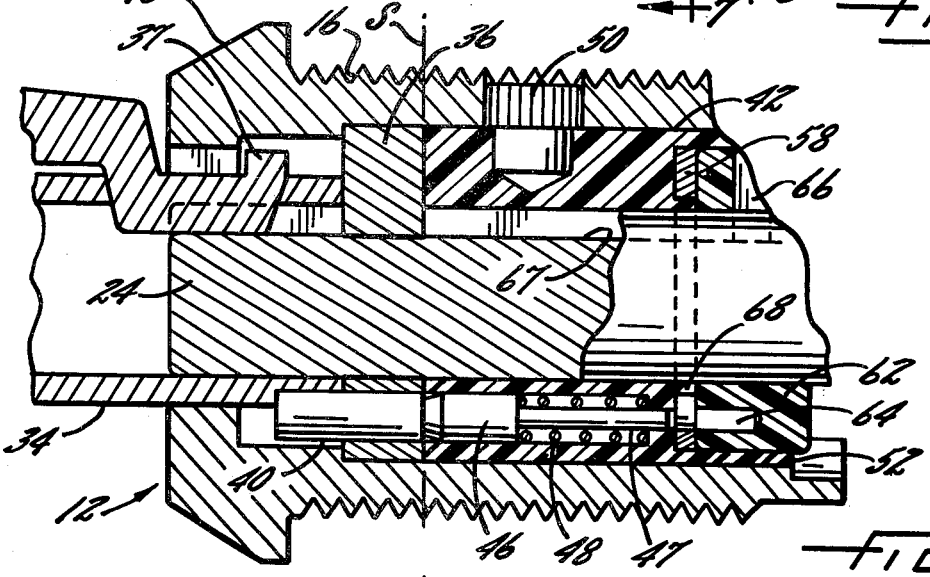
FIG. 4 is a fragmentary enlarged sectional view similar to FIG. 3, but with a portion of the key of FIG. 1 shown in engagement with the lock.

Referring to FIG. 4, the lock 12 is shown in a condition when the proper key 34 has been inserted and pins 40 have driven the locking pins 46 to the shear planes at which time the spindle 24 can be rotated to unlock the lock. Again, it will be noted that stems 47 do not make any contact with the electrical contact element 58.

Figure 5:
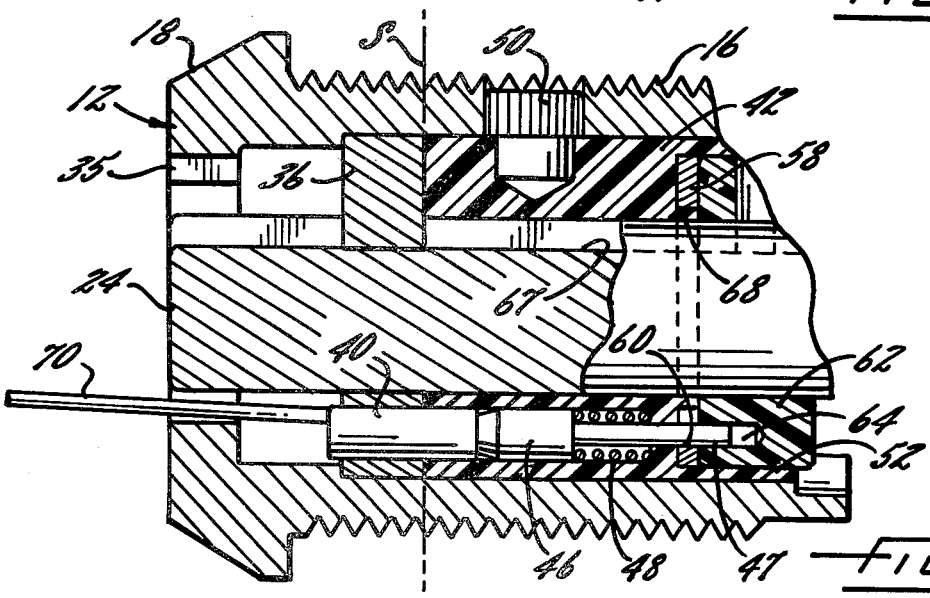
FIG. 5 is a fragmentary longitudinal sectional view similar to FIG. 4, but with the key removed and illustrating the condition of the lock when a picking attempt is made.

In accordance with the present invention, there is illustrated in FIG. 5, an example of a condition that can occur when an attempt is made to pick the lock such as by insertion of a picking tool 70. The pressing of the tool 70 against a driver pin 40 urges the locking pin 46 rearwardly and stem 47 can move through the contact element notch 60 into a bore 64 of the insulating ring 62. This elongated path of travel for the stem 47 makes it more difficult for the transmittal of a feel as to the location of the shear plane S. More importantly, since as a part of a picking operation it is necessary to apply a torque to the spindle and to keep it torqued while picking, the passage of the stem into the bore 64 of insulating ring 62 which is fixed to the spindle 24 prevents the application of the torque to spring the lock. The slight torquing that will move the stem 47 just enough to contact a side wall of the notch 60 will close the electrical circuit and trigger the alarm. Since contact can be made along the entire length of the stem 47, the closing of the circuit is not just instantaneous at an extreme end of travel which presents both a feel and sound, but the sounding and the feel have been separated.

Figure 8:
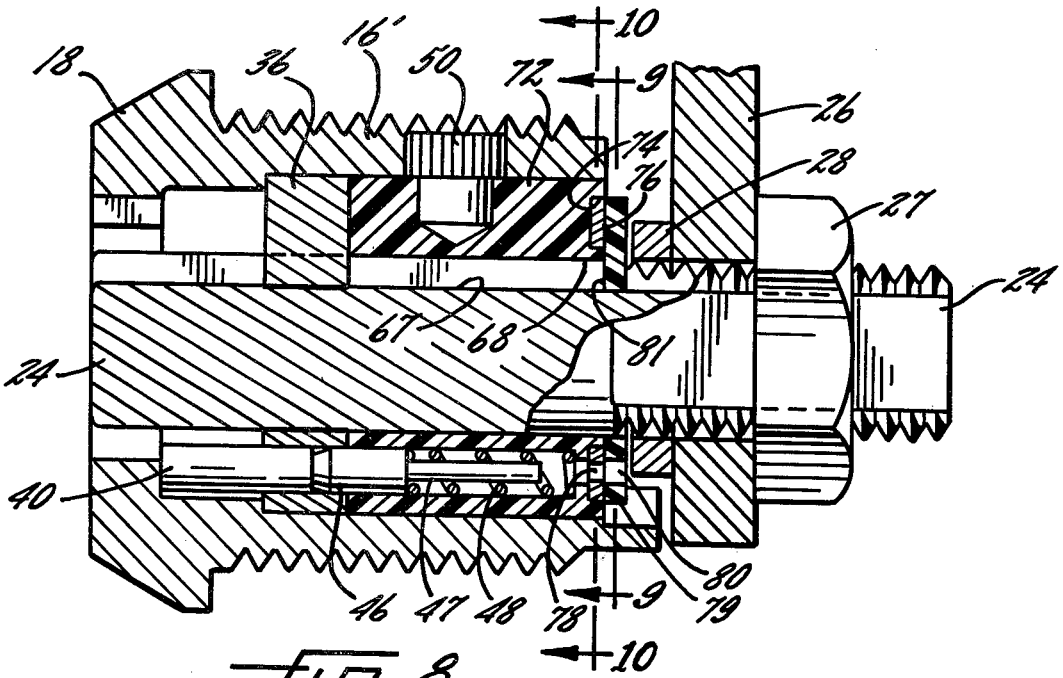
FIG. 8 is an enlarged longitudinal sectional view of an alternative embodiment of the axial pin tumbler lock with switching capability in accordance with the present invention.
Figure 10:
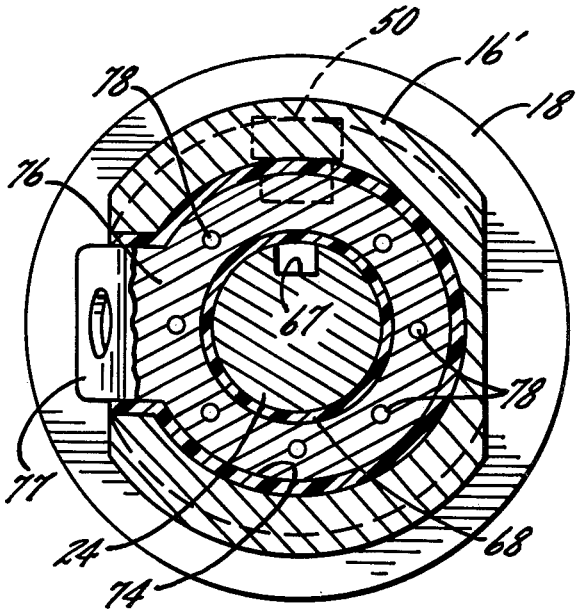
FIG. 10 is a transverse sectional view taken along the line 10—10 in FIG. 8.

Turning now to FIG. 8, there is shown a slightly modified version of the instant invention, where the same components and arrangement is illustrated set up in the most conventional and typical size axial pin tumbler lock housing, i.e., the five-eights inch size rather than a specialized elongated housing so that the alarm switch capability lock can be retrofitted with the numerous existing axial pin tumbler locks already present on equipment. It will be noted that for the sake of convenience the parts which remain unchanged have been given the same numbers as in the previous embodiment. Thus, the housing 16' remains essentially the same but is foreshortened and has a virtually identical frusto conical head 18. The spindle 24, fixed tumbler sleeve 36, driver tumblers 40, and stemmed tumblers 46 also remain the same although the stems 47 may be slightly shortened. The stationary sleeve 72, however, is distinguished from the previous stationary sleeve 42 (FIG. 2) by eliminating the peripheral skirt end 54, and simply having the slight recess 74 which receives the contact element 76 that has a bent over connector prong 77 (FIG. 10). In addition, the contact element 76 is here provided with a plurality of bores 78 (FIG. 10) corresponding to the sleeve bores, but reduced so as to only be slightly larger than the stem 47 diameters. This allows the locking pin stems 47 to pass through the contact element and even the slightest degree of torque applied will complete the circuit contact.

Figure 9:
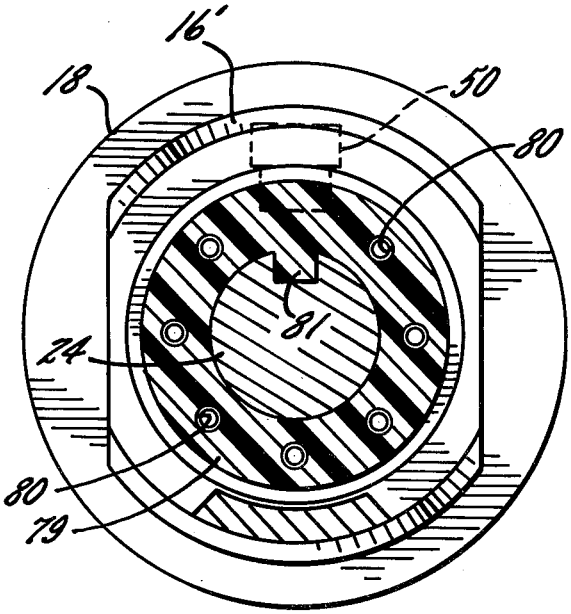
FIG. 9 is a transverse sectional view taken along the line 9—9 in FIG. 8.

In the present embodiment, the insulating ring 79 is made substantially thinner than the previous insulating ring 62, but again includes a plurality of bores 80 similar to the bores 64 of the ring 62 which are reduced diameters to receive the pin stems 47. Furthermore, rather than providing a pin 66 (FIG. 2), the ring 79 has an inwardly projecting lug 81 (FIG. 9) which meets with the slot 67 in spindle 24 and fixedly holds the ring 79 from rotation with respect to the spindle.

Again, in the present embodiment use of a proper key in the lock will not produce any contact with any of the locking pin stems 47 and the electrical contact ring 76, but any attempt to pick the lock which moves a pin stem through opening 78 of the contact ring and into the opening 80 of the insulating ring will both thwart the ability to apply meaningful torque to the spindle and will trigger the alarm by closing of the electrical circuit.

I claim as my invention:

1. An axial pin tumbler lock with electrical switch capabilities through the pins when subjected to an attempted picking, comprising in combination, a cylindrical lock body, a spindle having a driver pin sleeve fixed thereto insertable within the cylindrical body and defining an annular key way at the forward end of said body, said driver pin sleeve having a plurality of bores for receiving the driver pins, an annular stationary sleeve of insulating material with corresponding locking pin bores surrounding the spindle adjacent to the driver pin sleeve and fixed to the lock body, a plurality of stemmed locking pins disposed in the bores of the stationary sleeve and urged forwardly by spring means so that the locking pins normally project into the spindle sleeve bores preventing rotation of the spindle until a proper key inserted in the key way urges the locking pins through the driver pins into a shear plane between said sleeves to permit rotation of the spindle, an electrical contact element mounted at the rearward end of the stationary sleeve, said contact element having passages therethrough aligned with the locking pin stems, an insulating ring member fixedly mounted for rotation with the spindle, and said insulating ring member having a plurality of bores corresponding to the passages in the contact element so that when said locking pins are urged rearwardly beyond the shear plane such as in an attempted picking the stems move through the contact element passages into said insulating ring bores closing an electrical circuit between the contact element and said pin stems restrain the spindle from rotation by protruding into the insulating ring bores.

2. An axial pin tumbler lock as claimed in claim 1 wherein said contact ring passages are V-shaped notches.

3. An axial pin tumbler lock as claimed in claim 1 wherein said contact element passages are bores.

4. An axial pin tumbler lock as claimed in claim 1 wherein said stationary insulating sleeve has a rearwardly extending peripheral skirt which receives the insulating ring member.

5. An axial pin tumbler lock as claimed in claim 1 including means for connecting a first electrical circuit lead to said contact element and means connecting a second lead to said lock body and said leads form a part of an alarm circuit whereby engagement between a locking pin stem and the contact element will close the circuit to sound the alarm.

* * * * *